US005392479A

United States Patent [19]

Liao

[11] Patent Number: 5,392,479

[45] Date of Patent: Feb. 28, 1995

[54] MULTIPURPOSE SICKBED

[76] Inventor: Yu-Kuen Liao, No. 7, Lane 56, Fu-Shou St., Hsin-Chuang City, Taipei Hsien, Taiwan, Prov. of China

[21] Appl. No.: 188,549

[22] Filed: Jan. 28, 1994

[51] Int. Cl.[6] ..... A61G 7/05

[52] U.S. Cl. ..... 5/618; 5/937; 5/607

[58] Field of Search ..... 5/604, 607, 618, 937

[56] References Cited

U.S. PATENT DOCUMENTS

| | | | |
|---|---|---|---|
| 974,287 | 11/1910 | May | 5/937 |
| 2,215,636 | 9/1940 | Comper | 5/618 |
| 2,538,993 | 1/1951 | Travis | 5/618 |
| 2,633,578 | 4/1953 | Deves et al. | 5/618 |
| 4,499,618 | 2/1985 | Werner | 5/618 |
| 4,545,084 | 10/1985 | Peterson | 5/618 |
| 4,658,450 | 4/1987 | Thompson | 5/618 |

*Primary Examiner*—Michael J. Milano
*Attorney, Agent, or Firm*—W. Wayne Liauh

[57] ABSTRACT

Disclosed is a multipurpose sickbed including a head section which may be pivotally raised at a front end to form an inclination by means of a first control mechanism, a middle section which can be lowered by means of a fifth control mechanism to form a recess for accommodating a bedpan or a urinal, a rear section which may be pivotally raised at a rear end to form an inclination by means of a third control mechanism to more comfortably support the patient's feet; the head and the middle sections both consisting of a plurality of alternately disposed fixed boards and movable boards such that the movable boards may be lowered by a second control mechanism to disengage from the fixed boards to facilitate air ventilation of the sickbed; and all the head, middle, and rear sections being divided into a left and a right halves such that all the left halves can be synchronously inward inclined or all the right halves can be synchronously inward inclined to help the patient to either comfortably lie on his/her left side or lie on right side.

12 Claims, 13 Drawing Sheets

MULTIPURPOSE SICKBED

BACKGROUND OF THE INVENTION

To make a patient feel more comfortable when he or she is lying on a sickbed, the sickbed is usually so designed that a head portion and/or a rear portion thereof can be adjusted to incline at different angles. However, since not all the patients have the same sick condition and therefore, the inclination of the sickbed at its head portion and/or rear portion is not necessarily suitable for or meeting the requirement of all patients. Thus, it is still necessary for a tender to help the patient to lie on side or in other desirable position so that the patient may feel more comfortable. And, for a bedrid patient, sometimes two tenders are required to help the patient to the toilet room. It is therefore desirable to develop a multipurpose sickbed of which the head, middle, and rear portions as well as the left and right sides can be raised or lowered, inclined or leveled, or alternately raised for air ventilation purpose through different control mechanisms.

SUMMARY OF THE INVENTION

A primary object of the present invention is to provide a multipurpose sickbed, and more particularly to provide a sickbed of which the bed boards can be partially raised, lowered, inclined, and leveled through a number of control means. The sickbed according to the present invention is equipped with a first control mechanism which controls the axial inclination of a head section of the bed, a second control mechanism which control s the alternate raising of movable boards of the head and a middle sections of the bed, a third control mechanism which controls the axial inclination of a rear section of the bed so that a raised bed rear board forms a footrest, a fourth control mechanism which controls the leftward or rightward inclination of a left or a right side of the head, middle, rear sections of the sickbed so that the patient on the bed may lie on side, and a fifth control mechanism which controls the descent of the middle section of the bed for the positioning of a bedpan or a urinal thereat to facilitate the convenient and comfortable excretion of the patient.

In brief, the multipurpose sickbed according to the present invention is characterized in that:

1. The sickbed can be partially inclined at various angles through a number of control mechanisms and therefore, it is not necessary for a tender to directly turn the patient lying on the sickbed;
2. The middle section of the sickbed can be lowered to accommodate a bedpan or a urinal and therefore, the patient may conveniently and comfortably excrete on the sickbed;
3. The sickbed has movable bed boards which can be adjustably lowered for air ventilation purpose when the patient, especially a bedrid patient, feels uncomfortable due to lying in the sickbed for a long time;
4. The sickbed has a rear section which can be raised with a small utmost rear part thereof downward bent again to form a footrest for the feet of patient to be comfortably supported thereon;
5. The bed surface can be adjustably inclined through the control mechanisms and the sickbed is therefore very practical in use; and
6. The change of lying position and the excreting of the patient can all be taken care through the use of control mechanisms by the tender, and a lot of efforts and manpower can be saved.

BRIEF DESCRIPTION OF THE DRAWINGS

FIGS. 8 and 8-1 illustrate the assembly of the movable frame plates with the frame plate of the present invention;

DETAILED DESCRIPTION OF THE PREFERRED EMBODIMENT

Figure 1:
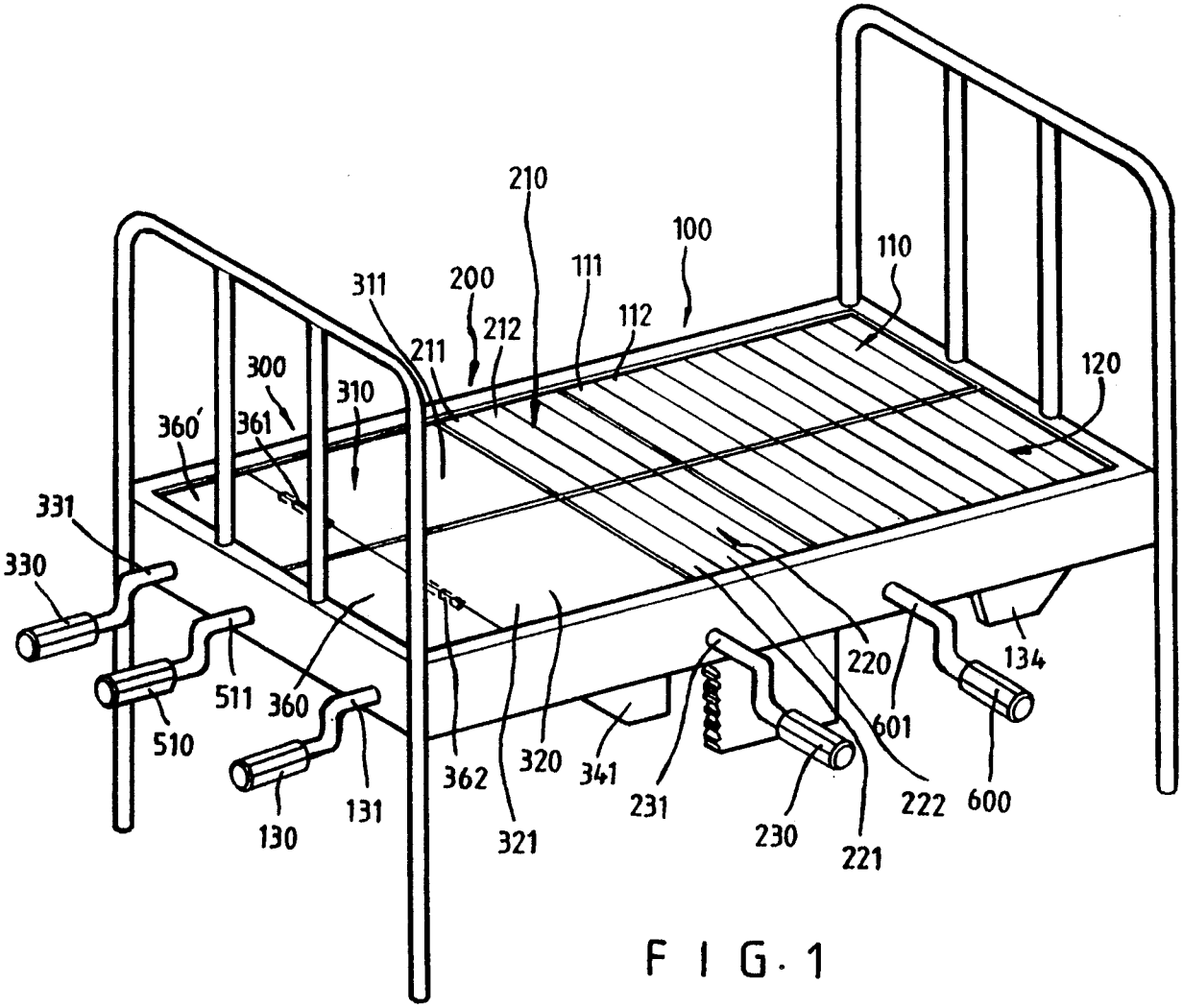
FIG. 1 is a perspective view of a sickbed according to the present invention.

Please refer to FIGS. 1, 2, 3, 5, 6, 7, 12, 13. A sickbed according to the present invention is divided into three sections, namely, a head section 100, a middle section 200, and a rear section 300. All of these three sections have the same bed board structure which includes a top layer, a middle layer, and a bottom layer.

The top layer of each section 100, 200, 300 includes a left half 110, 210, 310 and a right half 120, 220, 320. The left half 110, 210 consists of a plurality of alternately disposed fixed boards 111, 211 and movable boards 112, 212, and the right half 120, 220 also consists of a plurality of alternately disposed fixed boards 121, 221 and movable boards 122, 222.

The bottom layer of the head section 100 consists of a frame plate 140 having two laterally opposite rectangular openings 141, 141', a rotary shaft 142 fixed to a top middle portion thereof between the two openings 141, 141' and connecting a fourth and a fifth rotary wheels 144, 144' thereon, and two threaded rods 160, 160' rotatably connected near two side edges of the frame plate 140 by means of two pairs of fixing mounts 161, 161'.

Figure 8:
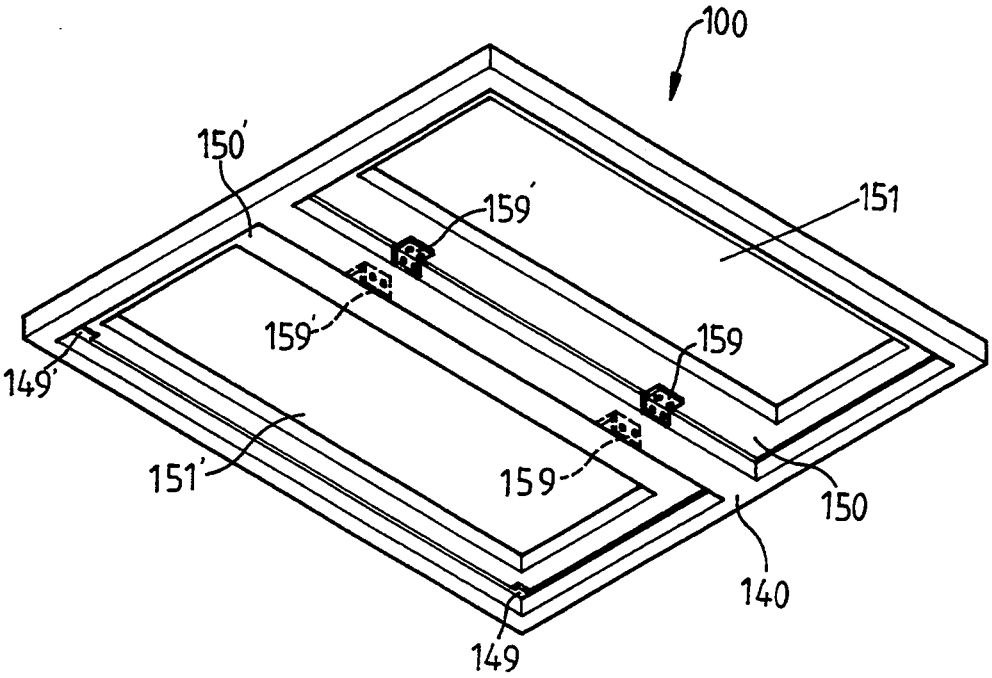
Figure 8A:
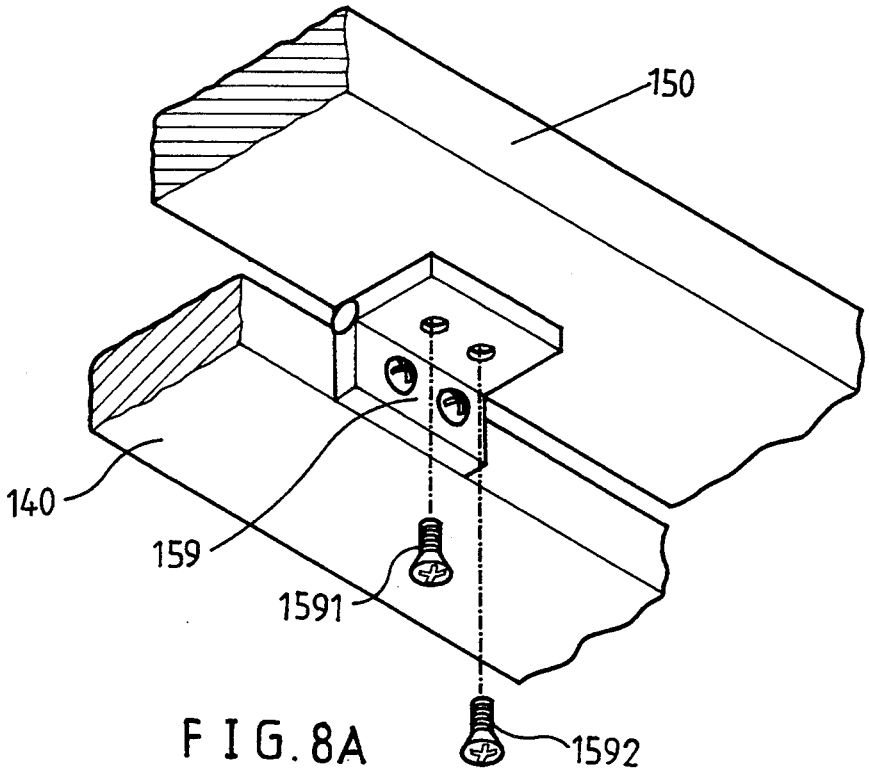
Figure 9:
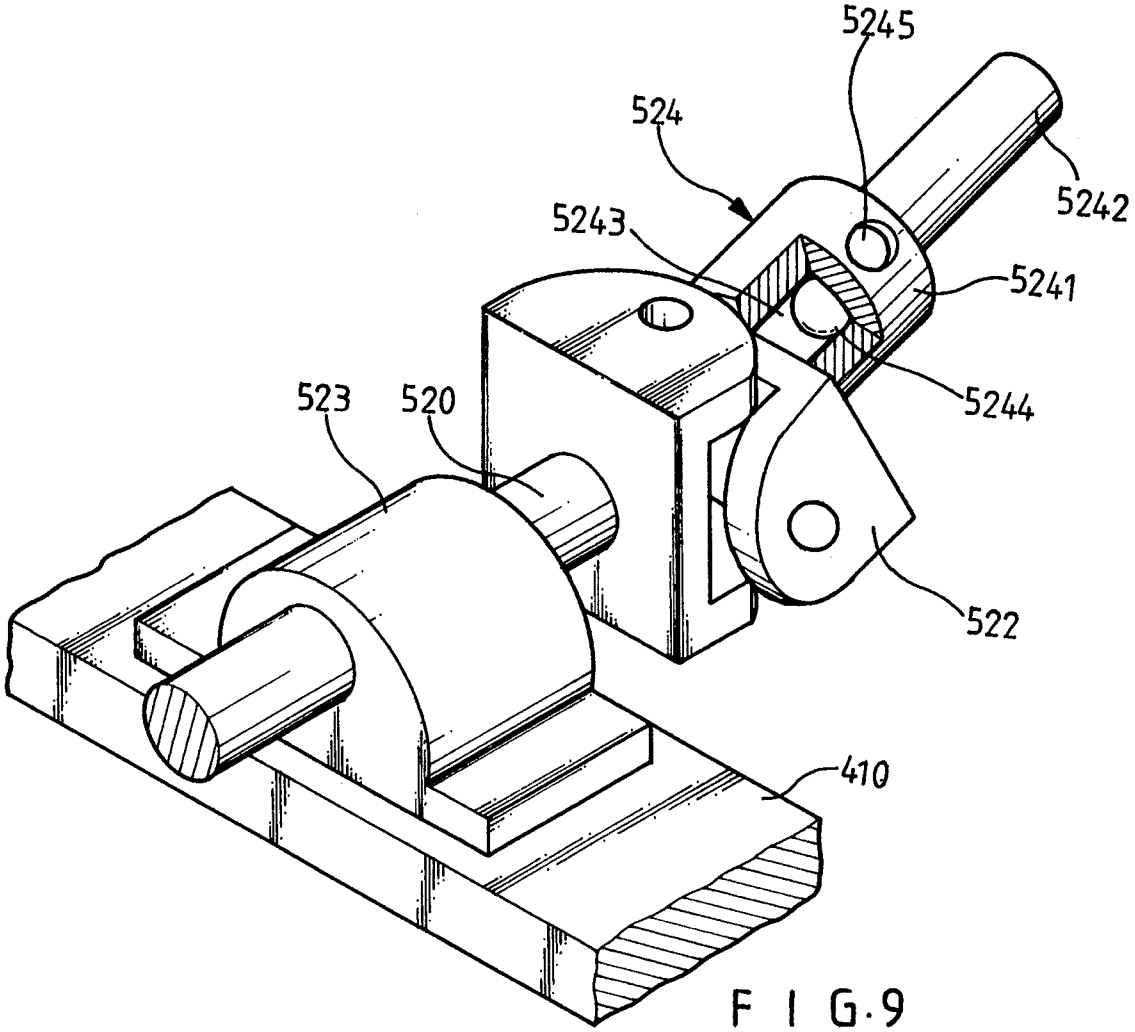
FIG. 9 is an enlarged view of the expansion rod of the present invention, in which a part of it is cut away for better explanation.
Figure 10:
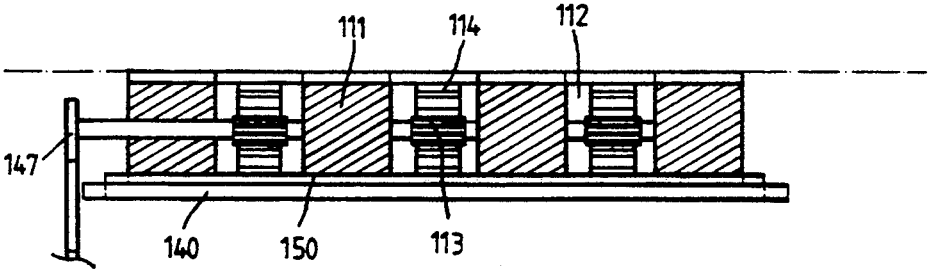
FIG. 10 illustrates the manner in which the movable bed boards of the present invention is operated.
Figure 11:
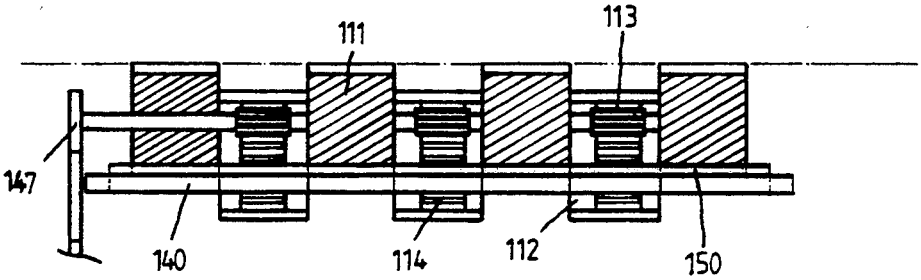
FIG. 11 is similar to FIG. 10 and shows a further operation of the movable bed boards of the present invention.
Figure 12:
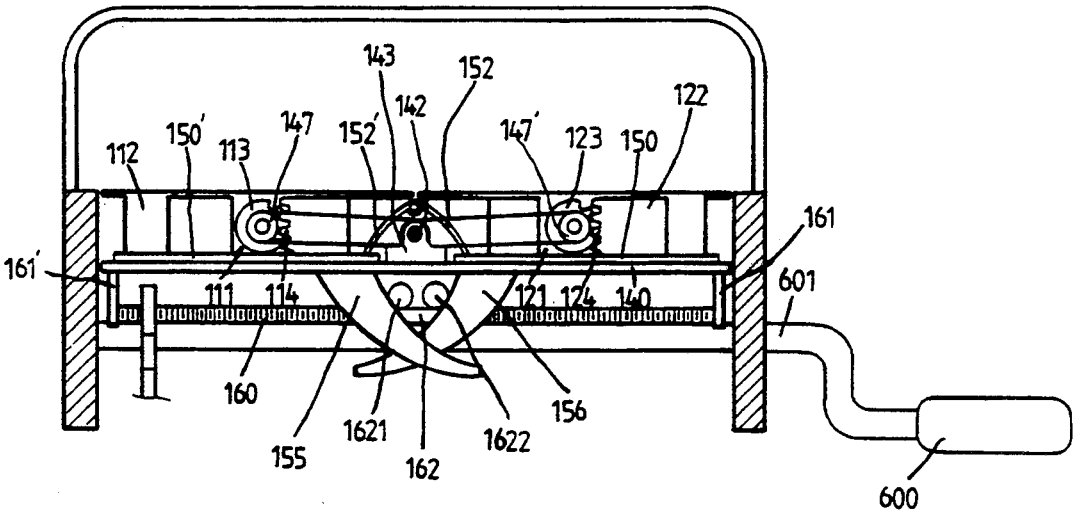
FIG. 12 is a sectional view of the middle section of the sickbed according to the present invention.

The middle layer of the head section 100 consists of two movable frame plates 150, 150' having an opening 151, 151′ therein and laterally disposed on the frame plate 140 within the two rectangular openings 141, 141′ and secured to the latter by means of hinges 159, 159′ and screws 1591, 1592, as shown in FIGS. 8 and 8-1, such that the movable frame plates 150, 150′ can be pivotly turned about the hinges 159, 159′.

Pads 149, 149′ are provided on a top surface of the frame plate 140 at proper positions to facilitate the smooth movement of the movable frame plates 150, 150′. When the movable frame plates 150, 150′ are lowered to a lowest position in the frame plate 140, the movable boards 112, 122 and the fixed boards 111, 121 are also retained within the openings 151, 151′ of the movable frame plates 150, 150′ with their bottom surfaces in the plane of the frame plate 140. The movable frame plates 150, 150′ are formed with a plurality of fixing holes 1111, 1211 on an outer side edge thereof, and connected on an upper inner side edge thereof two torsional leaf springs 152, 153, 152′, 153 ′ by means of screws 154, 154′ or by means of welding. Each pair of the torsional leaf springs 152, 152′, 153, 153 ′ are connected to each other by means of a pin 157, 157′ passing through pin holes 158, 158′ formed at another end of the torsional leaf springs 152, 152′, 153, 153′. Moreover, half-crescent members 155, 155′, 155″, 155‴, 156, 156′, 156″, 156‴ are provided between the two movable frame plates 150, 150 ′ at a lower inner edge thereof.

Please refer to FIGS. 1, 2, 3, 4, and 7. The sickbed of the present invention is equipped with five control mechanisms, namely, the first, the second, the third, the fourth, and the fifth control mechanisms 130, 510, 330, 600, 230.

The first control mechanism 130 is used to control the head section 100 and consists of a crank handle 130 near the rear end of the sickbed, a main shaft 131 integrally extending from the crank handle 130 and having a threaded section 132 formed at a predetermined position thereon, an internally threaded block 133 engaged with the threaded section 132 and having two stoppers 1331, 1332 formed at two sides thereof, and a trapezoidal member 134 having two spaced and downward tapered legs and an axially extended middle groove 1341 formed between the two legs so that the trapezoidal member 134 is received between the two stoppers 1331, 1332 with the threaded section 132 passing through the middle groove 1341. By this arrangement, when the first control mechanism 130 is turned, the internally threaded block 133 is prevented from turning along with the threaded section 132 but moves forward or backward thereon in a linear movement and thereby drives the trapezoidal member 134 to move upward or downward, respectively. The two legs of the trapezoidal member 134 have two outward projected flanges 1342, 1342′ by which the trapezoidal member 134 is stopped at a certain height without disengaging from the internally threaded block 133 when it is moved upward by the same. Since an upper end of the trapezoidal member 134 is fixed to the frame plate 140, when the trapezoidal member 134 is moved upward through the first control mechanism 130, the head section 100 of the sickbed is lifted to form an inclination as shown in FIGS. 2 and 3.

Figure 2:
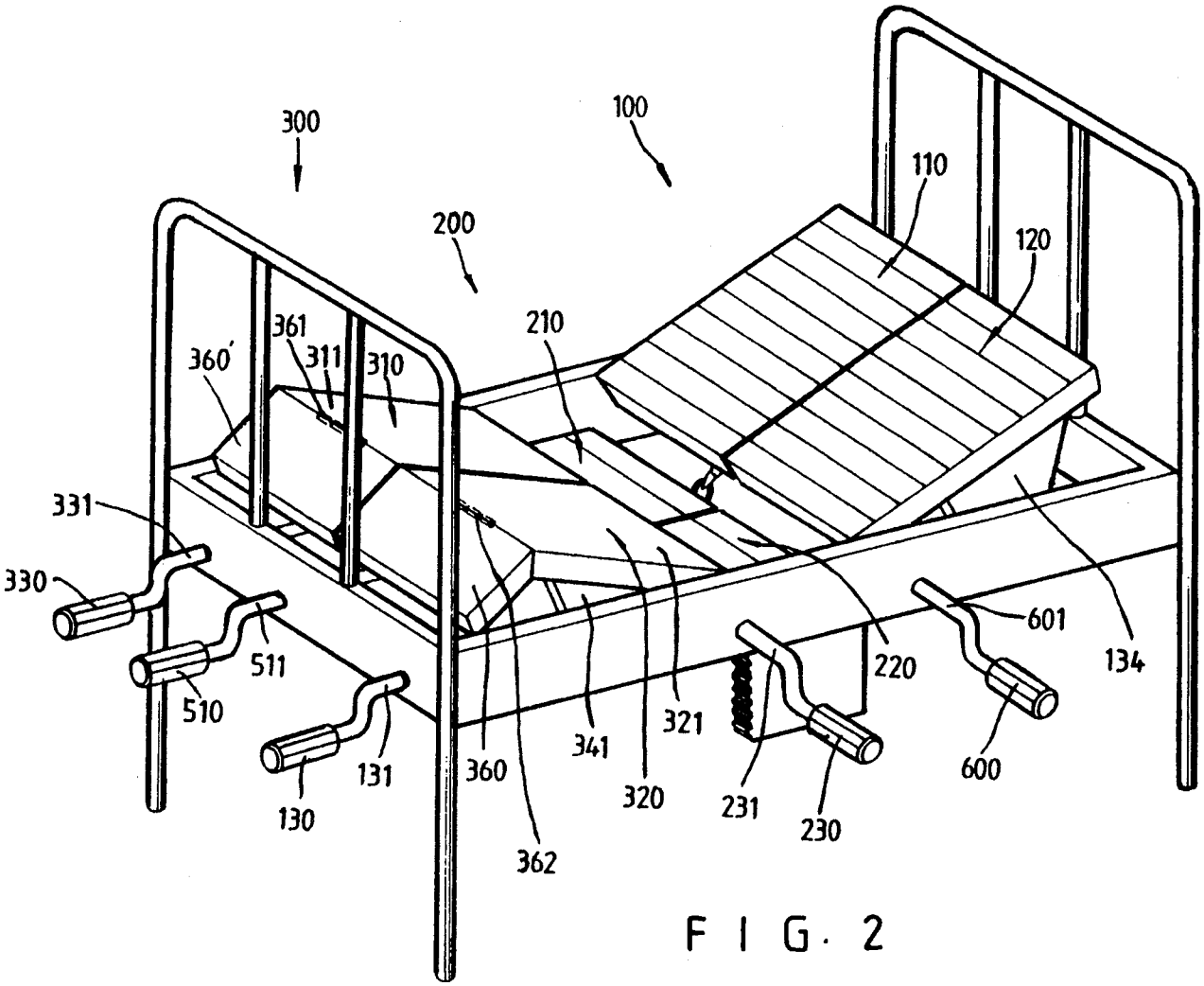
FIG. 2 is still a perspective view of the sickbed of the present invention, in which the bed boards are inclined, lowered, or raised to show the operation thereof.
Figure 3:
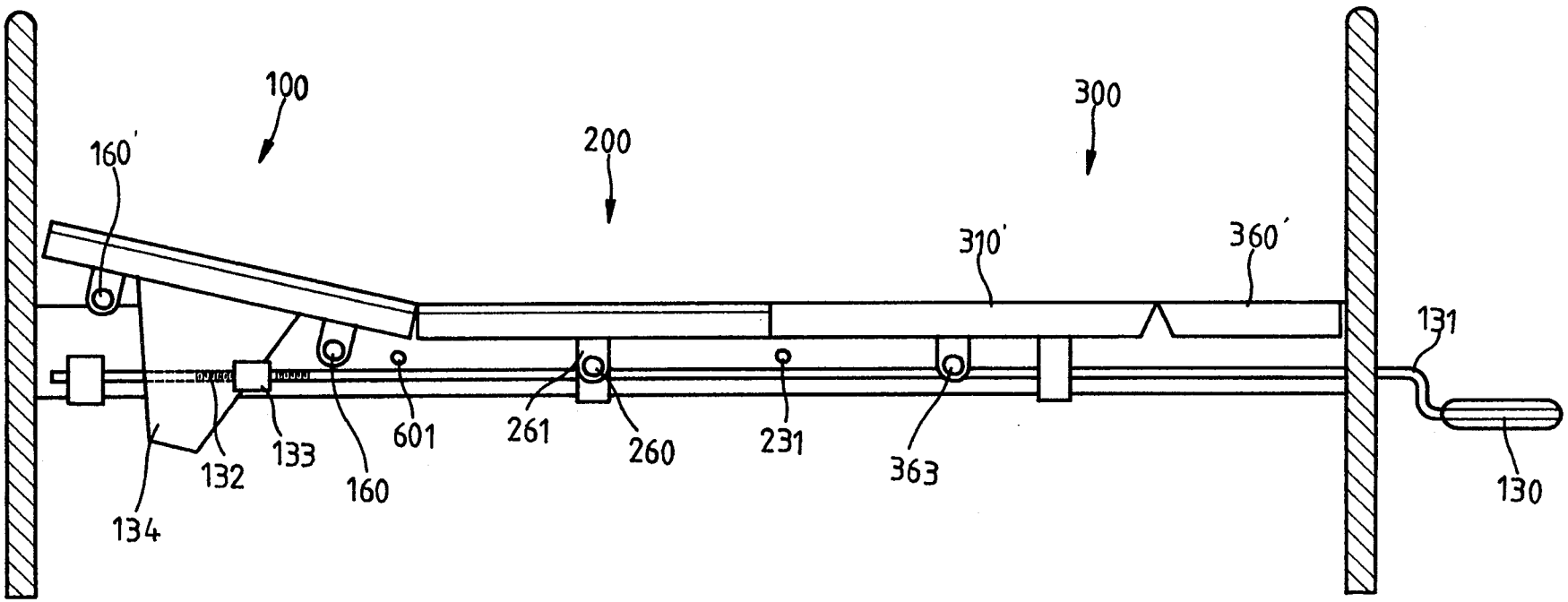
FIG. 3 shows the operation of the first control mechanism of the present invention.
Figure 4:
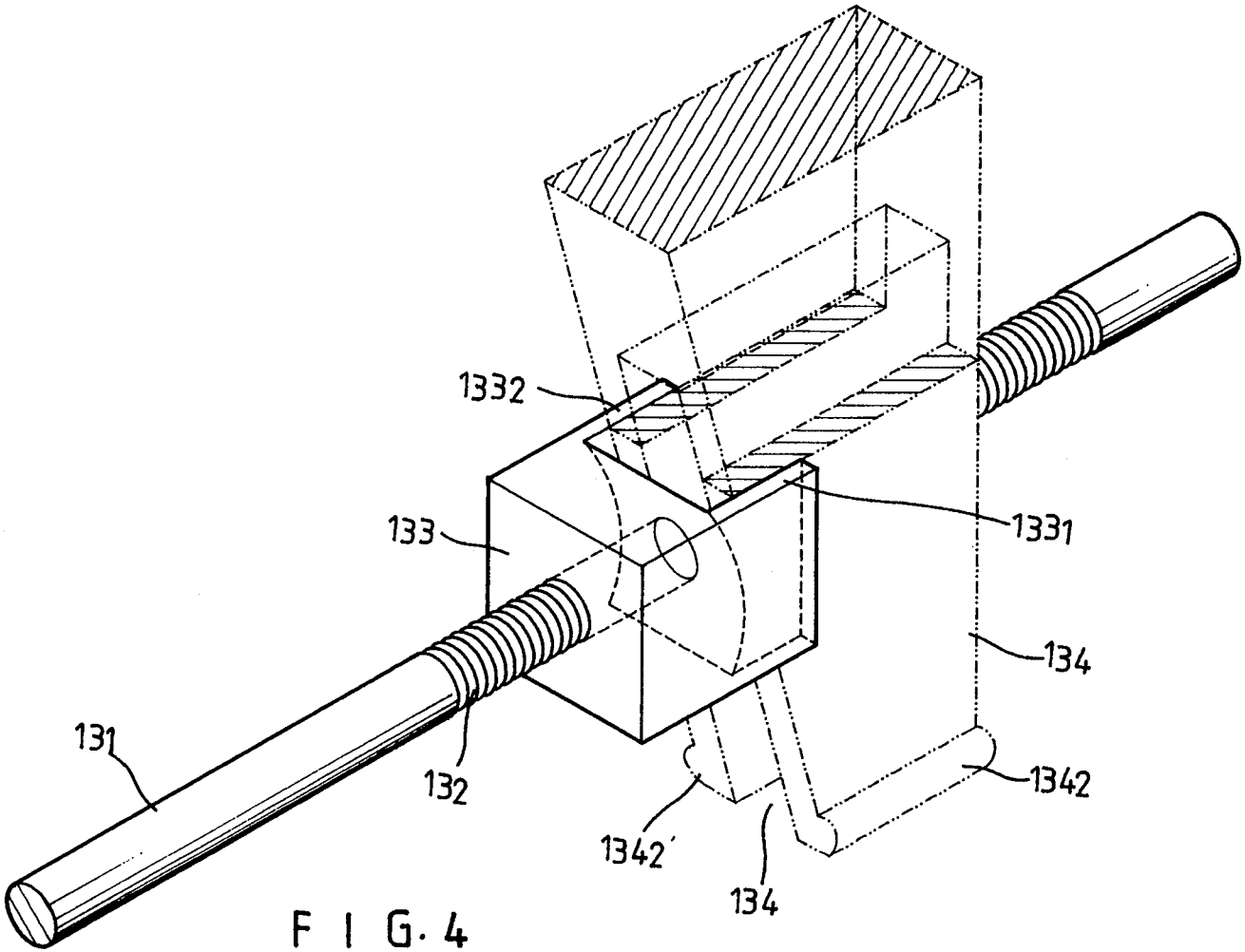
FIG. 4 is an enlarged view showing the trapezoidal member of the present invention.
Figure 5:
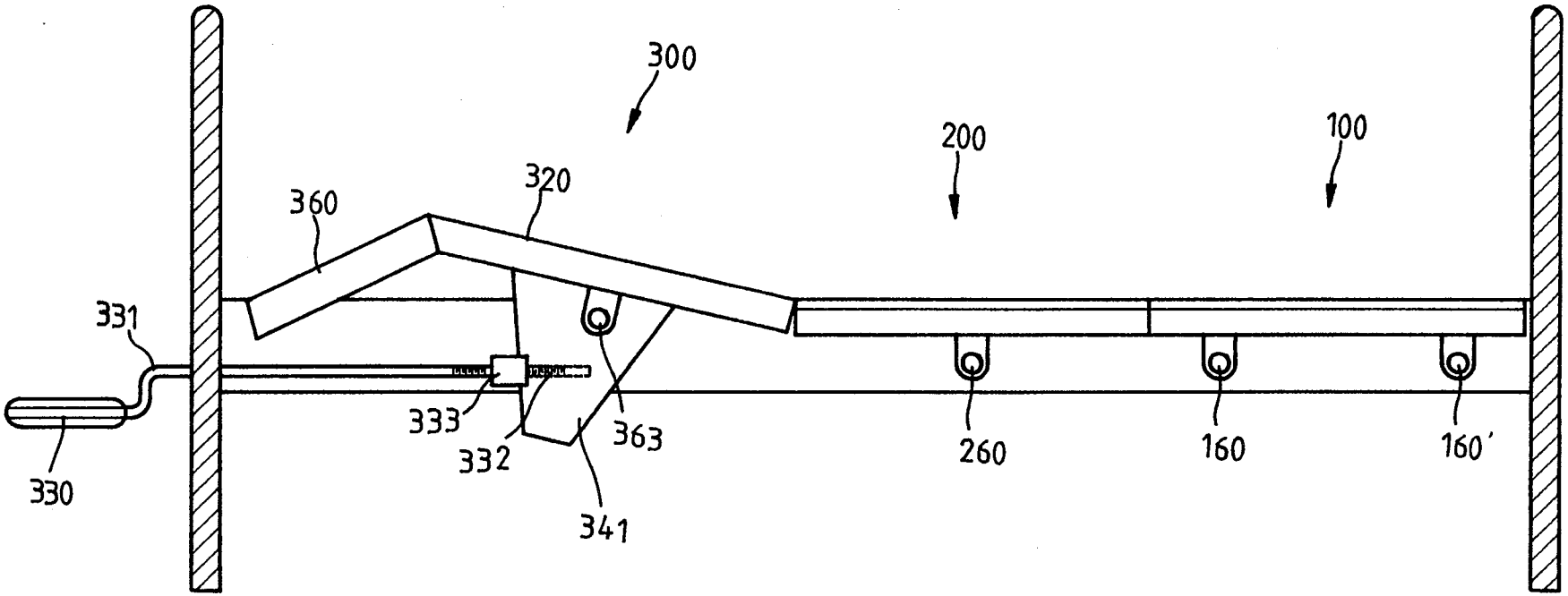
FIG. 5 shows the operation of the third control mechanism of the present invention.

Please refer to FIGS. 1, 2, and 5. The rear section 300 of the present invention can be inclined through the third control mechanism 330 in the same manner as that adopted by the first control mechanism 130 to incline the head section 100. The third control mechanism 330 consists of a crank handle 330, a main shaft 331, a threaded section 332, an internally threaded block 333, and a trapezoidal member 341, respectively having the same structure as that of the crank handle 130, main shaft 131, threaded section 132, block 133, and member 134. When the crank handle 330 is turned in a first direction to drive the main shaft 331 and the threaded section 332 to turn, the internally threaded block 333 further drives the trapezoidal member 341 to move upward, so that the rear section 300 connected to the trapezoidal member 341 is lifted to form an inclination as shown in FIGS. 2 and 5. And the descent of the rear section 300 is done with the help of gravity and a turning of the third control mechanism 330 in a second reverse direction. To avoid repeated description, the structure shown in FIG. 5 has been simplified.

The left and the right halves 310, 320 of the rear section 300 each consists of a fixed board 311, 321 and a foot-support board 360, 360′ which is pivotally connected to the fixed board 311, 321 by means of a hinge 361, 362, such that when the rear section 300 is lifted by the trapezoidal member 341, it is bent about the hinges 361, 362 and the fixed boards 311, 321 are inclined forward and the foot support boards 360, 360′ are inclined rearward, as shown in FIGS. 2 and 5, for the patient's feet to put thereon.

Please refer to FIGS. 1, 2, 6, 7, 9, 10, 11, and 12 for the details of a elevation mechanism 500 for the head and the middle sections 100, 200 of the present invention. The elevation mechanism 500 is actuated by the second control mechanism 510 and mainly consists of a crank handle 510; a main shaft 511 one end of which is integrally connected to the crank handle 510 and the other end connects a first rotary wheel 512; a second rotary wheel 521 being driven to rotate by the first rotary wheel 512 through a chain 513 connecting them; a universal joint 522 which together with the second rotary wheel 521 form a transmission component 520 which is secured onto a fixed supporting member 410 by means of a fixing mount 523 such that the second rotary wheel 521 and the universal joint 522 turn synchronously; an expansion rod 524 connected to an upper portion of the universal joint 522 and having a base 5241 inside which a long groove 5243 is formed to fixedly receive an extended rod 5242 therein by means of a pin 5244 threading through a pin hole 5245 on the base 5241, such that when the base 5241 is turned, the extended rod 5242 turns simultaneously; and a fixing means 530 which linearly fixes the expansion rod 524 and the rotary shaft 142 to two ends thereof such that the rotary shaft 142 and the expansion rod 524 turn synchronously.

When the second rotary wheel 521 is turned, the universal joint 522 turns simultaneously, causing the expansion rod 524 connected to the universal joint 522 and the rotary shaft 142 to turn synchronously. The turning of the rotary shaft 142 causes the fourth and the fifth rotary wheels 144, 144′ to synchronously turn, too. At this point, a seventh and an eighth rotary wheels 147, 147′ respectively connected with the fourth and the fifth rotary wheels 144, 144′ through chains 145, 145′ and separately fixed to the left and the right half 110, 120 of the head section 100 are driven to rotate, too.

Figure 6:
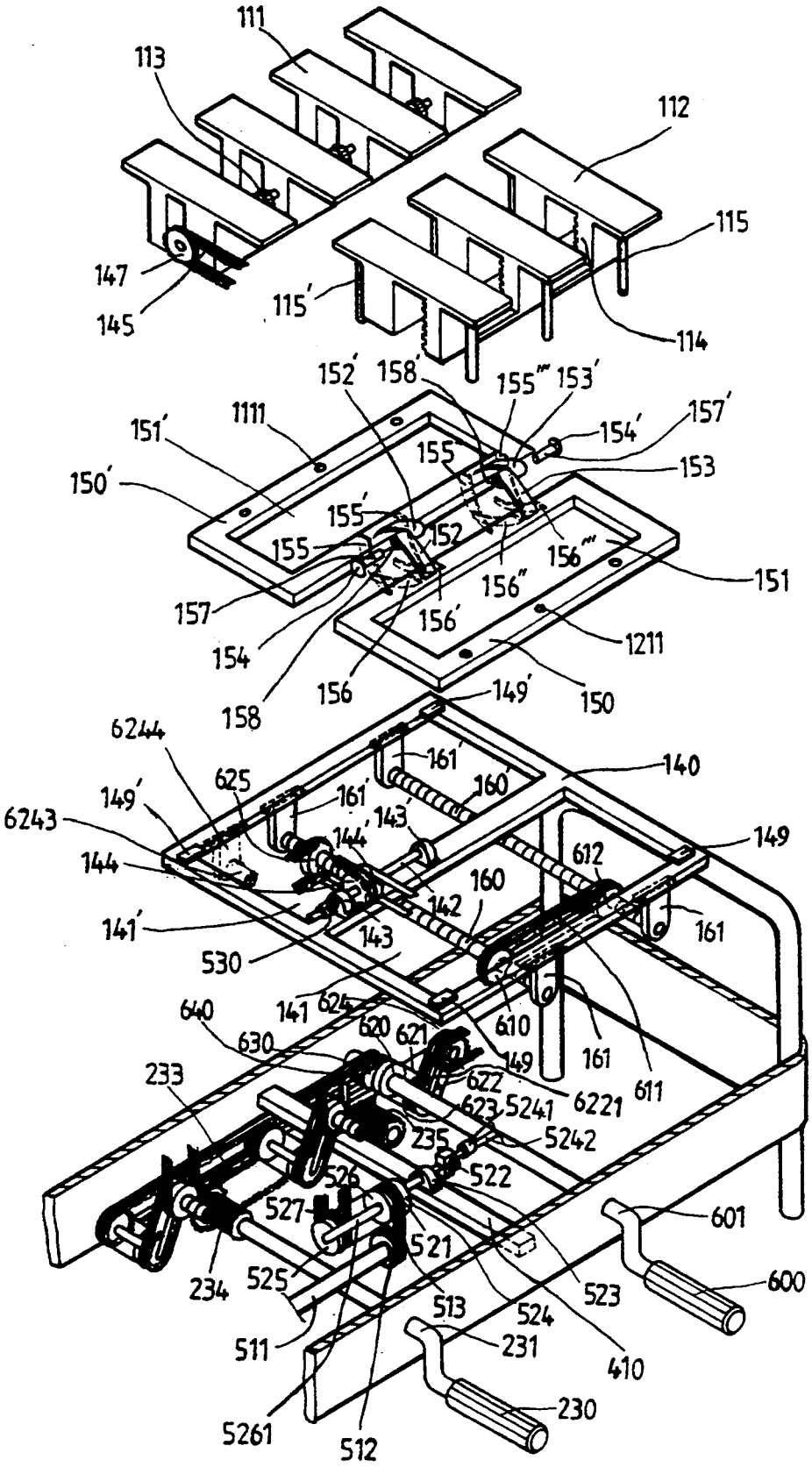
FIG. 6 is a disassembled perspective of the present invention.
Figure 7:
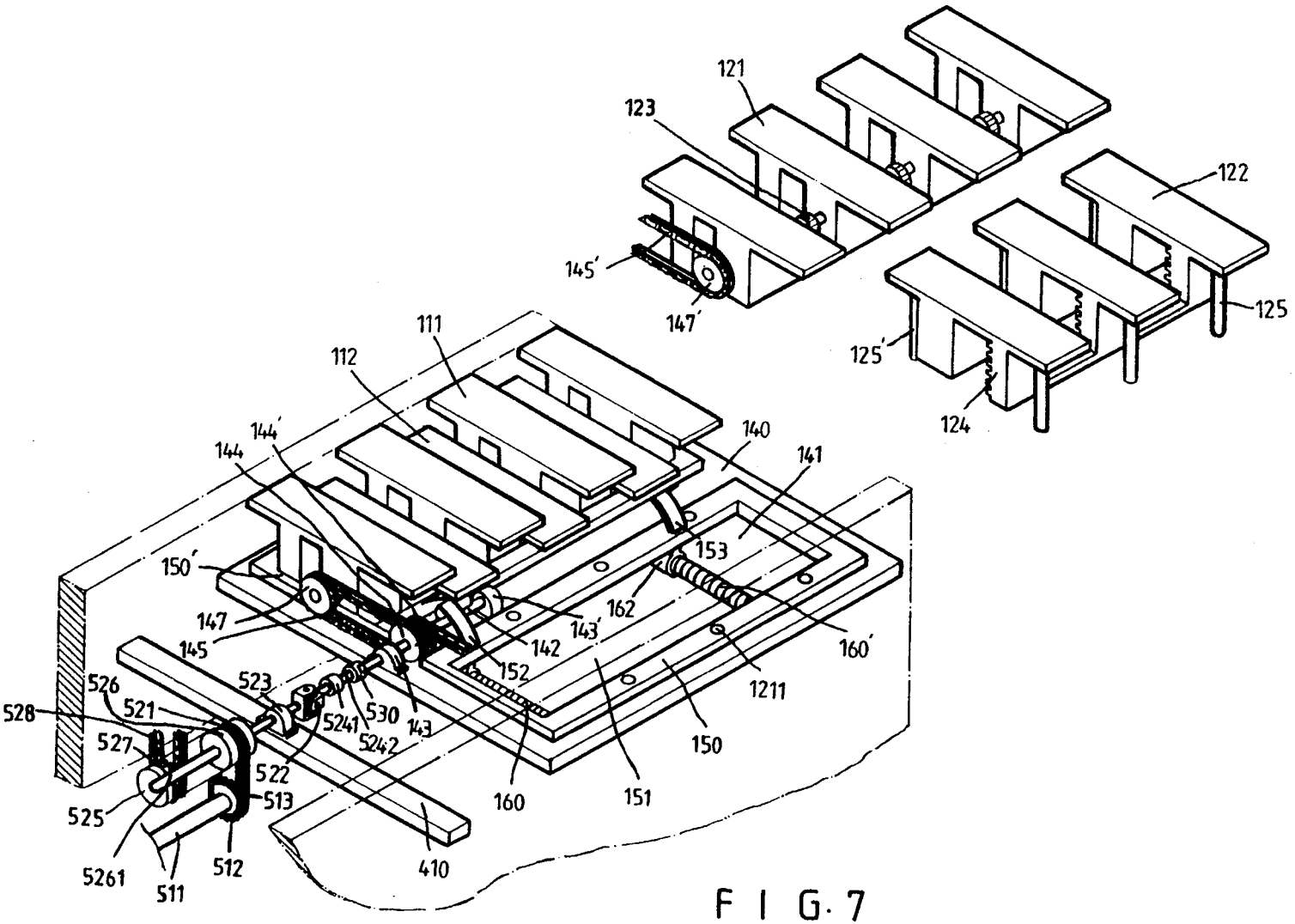
FIG. 7 illustrates the assembly of the present invention.

Please particularly refer to FIGS. 6 and 7 for the connection between the fixed boards 111, 121 and the movable boards 112, 122. The fixed boards 111, 121 are parallelly spaced and connected one another by an axle with a gear 113, 123 provided on the axle at each space between every two of the fixed boards. The movable boards 112, 122 are parallelly spaced and each is disposed in a space between the fixed boards 111, 121 and each of them is provided with a rack 114, 124 which engages with one of the gears 113, 123. Since the seventh and the eighth rotary wheels 147, 147' are separately fixed to the axle of the fixed boards 111, 121, the turning of the seventh and the eighth rotary wheels 147, 147' causes the axles and accordingly the gears 113, 123 to rotate and the latter further bring the racks 114, 124 to move upward or downward. To facilitate the ascent or descent of the movable boards 112, 122, they are provided with guide bars 115, 115', 125, 125' which linearly slide up or down in the holes 1111, 1211 formed on the movable frame plates 150, 150'. The descent of the movable boards 112, 122 to separate from the fixed boards 111, 121 permits better air ventilation of the sickbed.

The elevation mechanism 500 further includes a third rotary wheel 526, a sixth rotary wheel 525 connected to the third rotary wheel 526 via a link 5261, and a ninth rotary wheel 527 being coaxial with the sixth rotary wheel 525. The ninth rotary wheel 527 is further connected to a tenth rotary wheel 243 via a link (not shown) and drives the latter to rotate by a chain 528. The tenth rotary wheel 243 locates at a top middle portion of the middle section 200 between the two second movable frame plates 250, 250'. Thus, when the middle section 200 is lowered or elevated by a fifth control mechanism 230 as shall be described in details hereinafter, the distance between the third rotary wheel 526 and the tenth rotary wheel 243 changes, accordingly. However, since the ninth rotary wheel 527 may cooperates with the sixth rotary wheel 525 to adjust their position with the lowering or elevation of the tenth rotary wheel 243, and since the sixth rotary wheel 525 connects with the third rotary wheel 526 via the link 5261, the moved middle section 200 can still be driven by the third rotary wheel 526.

Please now refer to FIGS. 1, 2, 3, 5, 12, and 13. The middle section 200 has substantially the same structure as that of the head section 100, that is, consists of a top layer including the left and the right halves 210, 220 each consists of fixed boards 211, 221 and movable boards 212, 222; a middle layer including movable frame plates 250, 250' provided with pads 249, 249'; and a bottom layer including a frame plate 240 having rectangular openings 241, 241'. A rotary shaft 248 is fixed onto the frame plate 240 between the two movable frame plates 250, 250' at a predetermined position by means of fixing mounts 242, 242'. The above-mentioned tenth rotary wheel 243 and an eleventh and a twelfth rotary wheels 244, 245 are fixed to the rotary shaft 248. The tenth rotary wheel 243 is driven to rotate by the ninth rotary wheel 527 via a chain 528, such that the eleventh and the twelfth rotary wheels 244, 245 are rotated to further drive thirteenth rotary wheels 246 fixed to one end of the fixed boards 211, 221.

Figure 13:
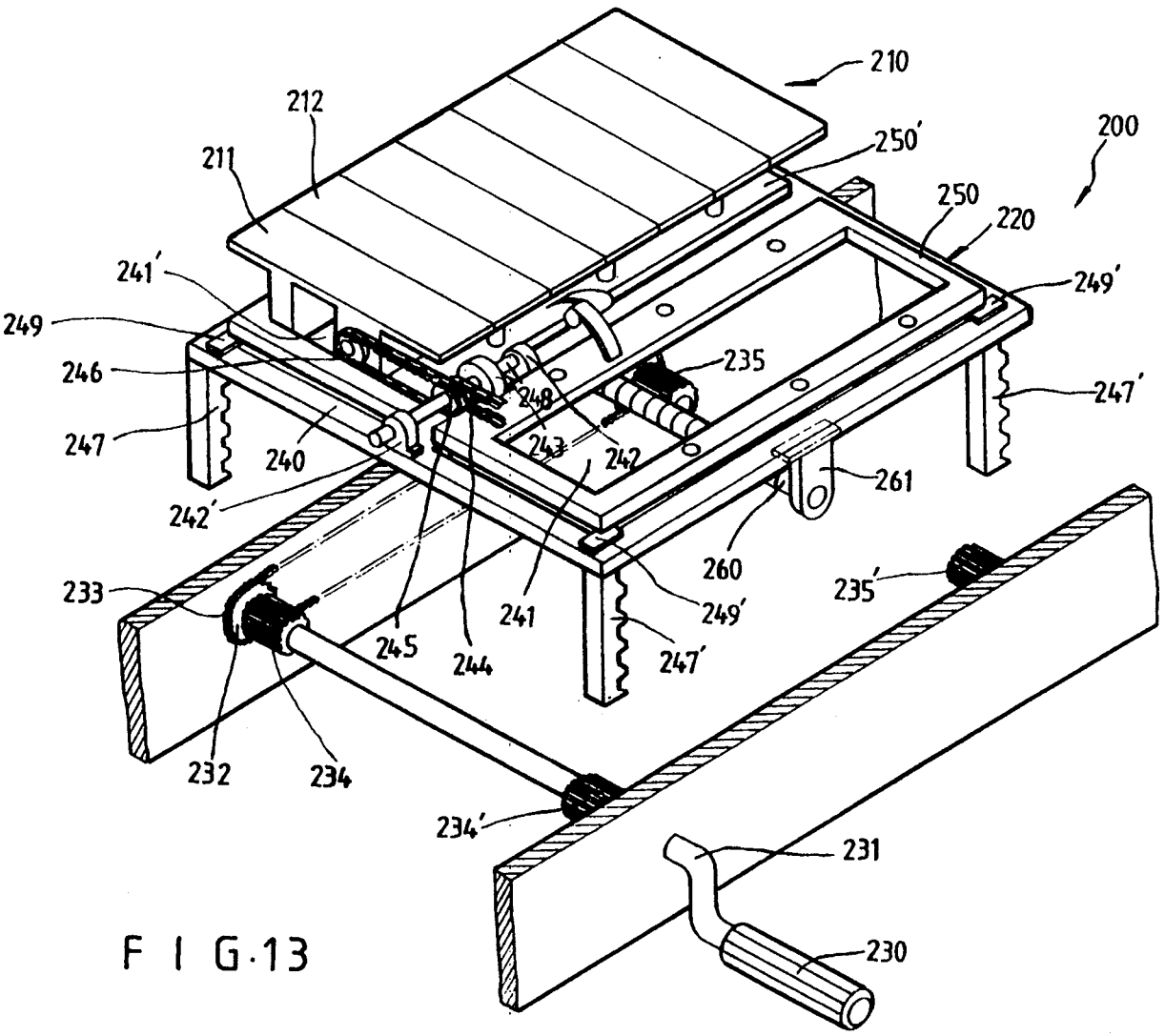
FIG. 13 is a disassembled perspective of the middle section of the sickbed according to the present invention.
Figure 14:
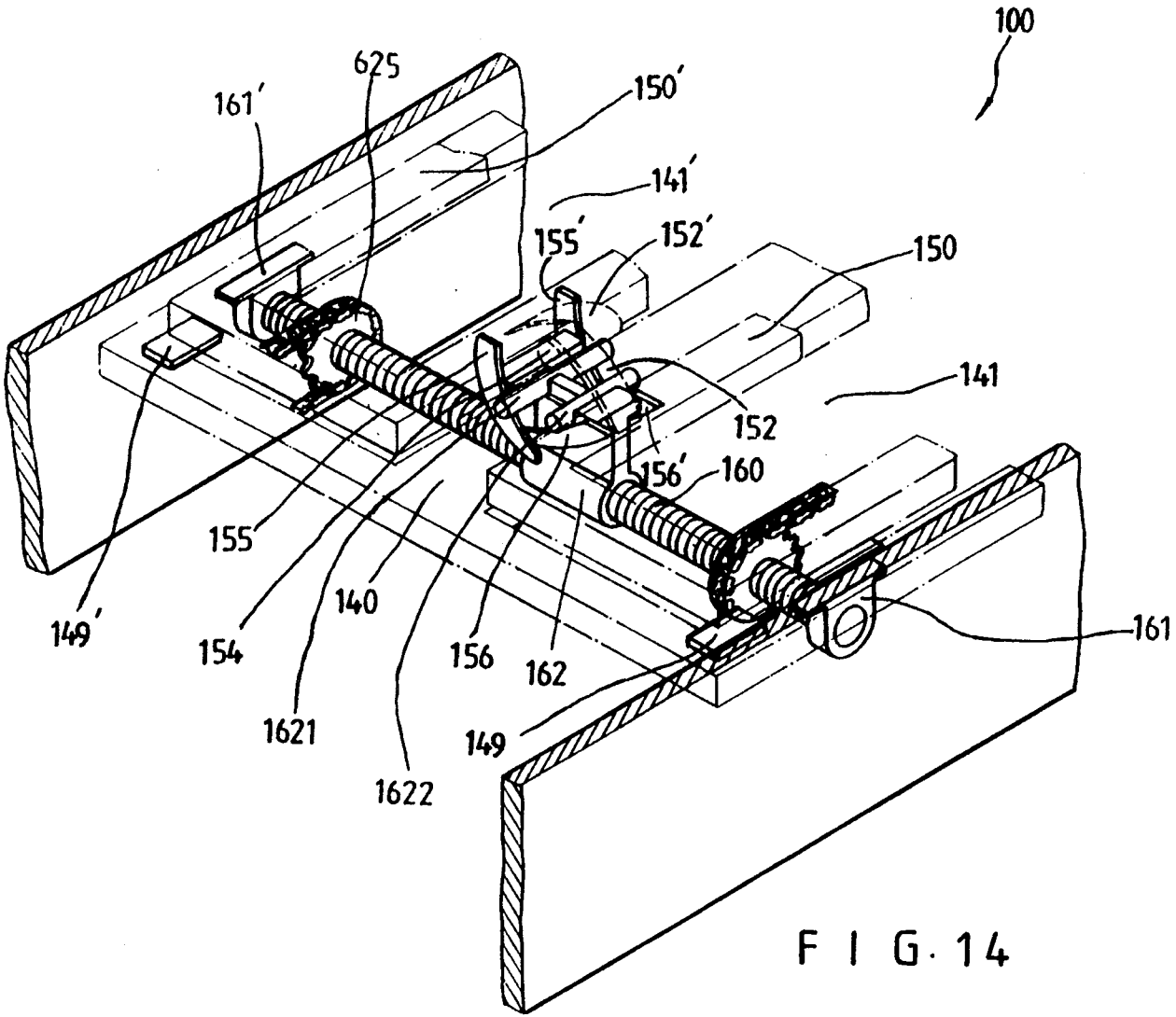
FIG. 14 illustrates the mechanism for inclining the left or the right half of the head section of the sickbed.
Figure 15:
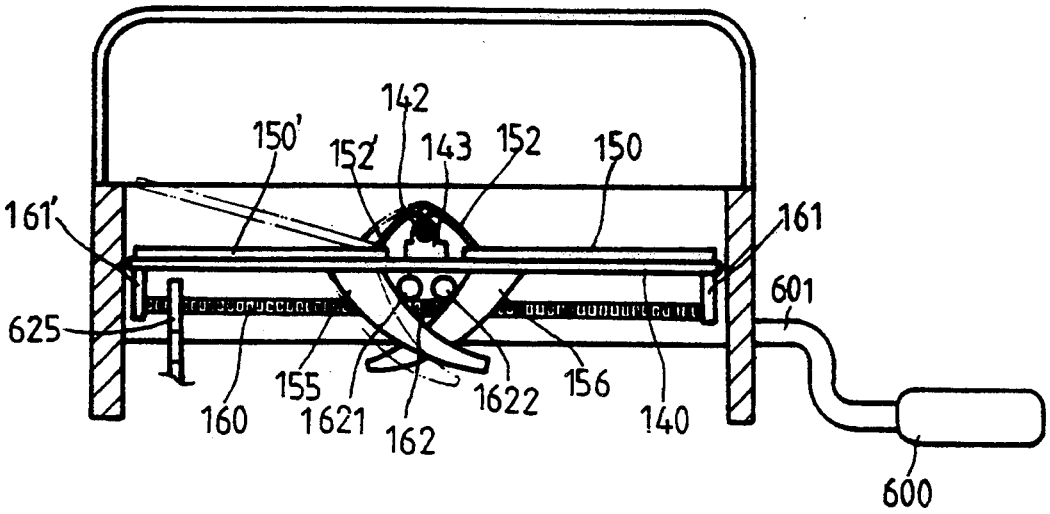
FIG. 15 illustrates the inclination of the left half of the head section of the sickbed.
Figure 16:
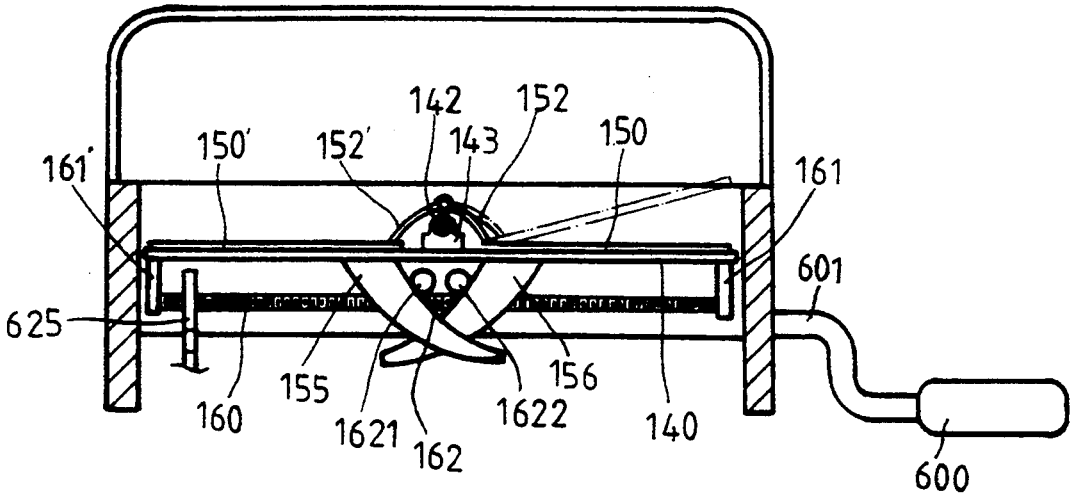
FIG. 16 illustrates the inclination of the right half of the head section of the sickbed.

As shown in FIG. 13, a threaded rod 260 is provided below the frame plate 240 of the middle section 200 and is fixed thereto by means of fixing mounts 261. The threaded rod 26 is used to control the inclination of the left and/or the right half 210, 220 and the structure thereof will be described in details as below.

The fifth control mechanism 230 of the present invention consists of a main shaft 231 extending between and fixed onto two lateral sides of the frame plate 240. On each end of the main shaft 231 inside the frame plate 240, a driving gear 234, 234' are provided to drive a driven gear 235, 235' through a chain wheel 232 and a chain 233 such that driven gears 235, 235' rotates with the driving gears 234, 234' synchronously.

The frame plate 240 has two pairs of racks 247, 247' formed at four bottom corners thereof engaging with the gears 234, 234', 235, 235', such that when the fifth control mechanism 230 is rotated, the gears 234, 234', 235, 235' fixed thereto drive the racks 247, 247' to move upward or downward and thereby, the middle section 200 is elevated or lowered.

When the middle section 200 is lowered, a recess so formed between the head and the rear sections 100, 300 can be used to accommodate a bedpan or a urinal to facilitate the excretion of the patient without leaving the sickbed. The tender can also save a lot of efforts.

Please further refer to FIGS. 1, 2, 3, 6, 10, 11, 12, and 13. The fourth control mechanism 600 has a main shaft 601 on which a fourteenth, a fifteenth, a sixteenth, and a seventeenth rotary wheels 610, 620, 630, 640 are provided. The fourteenth and the fifteenth rotary wheels 610, 620 are used to drive the threaded rods 160, 160', the sixteenth rotary wheel 630 is used to drive the inclination of the middle section 200, and the seventeenth rotary wheel 640 is used to drive the inclination of the rear section 300. Since the manner of transmission of these rotary wheels are similar to those of other rotary wheels mentioned in previous paragraphs, it is not repeated herein.

The fifteenth rotary wheel 620 connects an eighteenth rotary wheel 622 by means of a link 6221 and drives the latter to rotate via a chain 621. The eighteenth rotary wheel 622 is coaxial with a nineteenth rotary wheel 623 which is connected to a twentieth rotary wheel 624 via a link (not shown) and drives the latter to rotate through a chain (not shown). Due to the link connecting the nineteenth and the twentieth rotary wheels 623, 624, the distance between the two rotary wheels can be adequately adjusted when the movable frame plate 150 displaces. With these arrangement, when the fifteenth rotary wheel 620 drives the eighteenth, and accordingly, the nineteenth, and the twentieth rotary wheels 622, 623, 624 to rotate, a twenty-first rotary wheel 625 fixed onto the threaded rod 160 is driven to rotate the threaded rod 160. Since the twentieth rotary wheel 624 has a rotary shaft 6243 which is fixed to the frame plate 140 by means of a fixing bracket 6244 and drives the twenty-first rotary wheel 625 through a chain 627, the twentieth rotary wheel 624 shall rotate when the frame plate 140 is displaced. The turning of the twentieth and the twenty-first rotary wheels 624, 625 further causes the fourteenth rotary wheel 610 on the threaded rod 160 to drive via a chain 611 a twenty-second rotary wheel 612 on the threaded rod 160' to rotate and thereby the threaded rod 160' rotates with the threaded rod 160 synchronously.

The fourteenth, the sixteenth, and the seventeenth rotary wheels 610, 630, 640 all have the same transmission structure to effect displacement and position adjustment of the frame plate 140 and are therefore, not repeatedly described herein.

Referring to FIGS. 3, 5, 6, 7, 12, 13, 14, and 15. Since the threaded rods 160, 160', 260, 363 all have the same transmission structure, only the threaded rod 160 is described to explain the structure thereof.

The threaded rod 160 is provided near its middle point a control member 162 and at each end a twenty-first rotary wheel 625. When the fourth control mechanism 600 is rotated, due to the transmission by the rotary wheels mounted thereon as mentioned in the above paragraphs, the threaded rod 160 is turned in the same direction with the control member 162 moving leftward or rightward at the same time. The control member 162 has two support rod 1621, 1622 on its top and separately bearing against an inner side of the half-crescent members 155, 155', 156, 156' such that, when the control member 162 moves rightward, the movable frame plate 150 is pivotally raised at its outer edge to form an inclination while the other movable frame plate 150' is supported on the plane of the frame plate 140 without being lowered down. The fixed and the movable boards 121, 122 mounted on the movable frame plate 150 are thereby inclined, too. That is, only one lateral half of the sickbed is inwardly inclined so that the patient may be turned to lie on his/her right side. Similarly, when the fourth control mechanism 600 is rotated in a reverse direction so that the control member 162 on the threaded rod 160 moves leftward, the inclined right half of the sickbed shall be lowered down to recover its level position. And, when the control member 162 keeps moving leftward, the left half 110 of the sickbed shall be pivotally raised at its outer edge to form an inward inclination so that the patient may be turned to lie on his/her left side.

Among the four rotary wheels 610, 620, 630, 640 mounted on the fourth control mechanism 600, the 14th and the 15th rotary wheels 610, 620 are used to control the pivotal raising and inclination of the two halves of the head section 100, the 16th rotary wheel 630 is used to control the pivotal raising and inclination of the two halves of the middle section 200, and the 17th rotary wheel 640 is used to control the pivotal raising and inclination of the two halves of the rear section 300. That is, the fourth control mechanism 600 may control the whole bed surface of the sickbed, causing the left halves 110, 210, 310 or the right halves 120, 220, 320 thereof to pivotally raised at an outer edge to form an inward inclination at the same time to help the patient to lie on left or on right side.

Please refer to FIGS. 1, 2, and 5. The rear section 300 has substantially the same structure as that of the head section 100, except that there is only one fixed board 311, 321 forming the left and the right halves 310, 320 of the rear section 300. However, movable boards can also be provided for the rear section 300, depending on actual need. The fixed boards 311, 321 are supported on movable frame plates 350, 350' which are hinged at inner edge to a frame plate 340. The structure of this portion is the same as that of the head and the middle sections 100, 200 and is not repeated herein.

What is claimed is:

1. A multipurpose sickbed, comprising:

a head section having a top layer consisting of a first left and a first right halves, a middle layer consisting of two first movable frame plates for supporting said first left and said first right halves thereon, and a bottom layer consisting of a first frame plate having two rectangular openings in to which said two first movable frame plates are hinged; said first left and said first right halves each including a plurality of alternately disposed first fixed and first movable boards;

a middle section having a top layer consisting of a second left and a second right halves, a middle layer consisting of two second movable frame plates for supporting said second left and said second right halves thereon, and a bottom layer consisting of a second frame plate having two rectangular openings into which said two second movable frame plates are hinged; said second left and said second right halves each including a plurality of alternately disposed second fixed and second movable boards;

a rear section having a top layer consisting of a third left and a third right halves, a middle layer consisting of two third movable frame plates for supporting said third left and said third right halves thereon, and a bottom layer consisting of a third frame plate having two rectangular openings into which said two third movable frame plates are hinged; said third left and said third right halved each including only two third fixed boards;

a first control mechanism consisting of a first main shaft having a first threaded section formed at a predetermined position, a first internally threaded block engaged with said threaded section, and a first trapezoidal member connected at a top end to a bottom side of said first frame plate and at a lower portion to said first internally threaded block such that said first trapezoidal member is driven by said first main shaft and said first internally threaded block to move upward to raise a front end of said first frame plate to form an inclination when said first main shaft is rotated in a first direction, or to move downward to lower down a raised front end of said first frame plate to a level position when said first main shaft is rotated in a reverse second direction;

a second control mechanism consisting of a second main shaft with a first rotary wheel connected to one inner end thereof; said first rotary wheel driving through a chain a second rotary wheel, a universal joint, and a third rotary wheel mounted on a connecting rod to turn with said first rotary wheel synchronously; said universal joint having an expansion rod connected thereto for rotating a fourth and a fifth rotary wheels which further drive a seventh and an eighth rotary wheels attached to said first fixed boards to rotate; said seventh and said eighth rotary wheels being connected to an axle having first gears thereon between said first fixed boards to engage with first racks formed on said first movable boards such that the rotation of said seventh and said eighth rotary wheels cause said first gears to move said firs tracks up and down and thereby raises or lowers said first movable boards; a tenth rotary wheel being driven to rotate by a ninth rotary wheel which is also driven by said third rotary wheel, and said tenth rotary wheel further driving thirteenth rotary wheels attached to said second fixed boards of said middle section so that said second movable boards of said middle section is moved up or down in the same manner as that for moving said first movable boards up and down; said first and said second movable boards, when being lowered, facilitating the air ventilation of said sickbed;

a third control mechanism including a third main shaft having a second threaded section formed at a predetermined position, a second internally threaded block movably engaged with said second threaded section, and a second trapezoidal member connected at a top end to a bottom side of said third frame plate and at a lower portion to said second internally threaded block such that said second trapezoidal member is driven by said third main shaft and said second internally threaded block to raise a rear end of said third frame plate to form an inclination when said third main shaft is rotated in a first direction, or to lower down a raised front end of said third frame plate to a level position when said third main shaft is rotated in a second direction;

a fourth control mechanism having a fourth main shaft on which a fourteenth, a fifteenth, a sixteenth, and a seventeenth rotary wheels are provided to rotate synchronously; said fourteenth and said fifteenth rotary wheels being used to rotate two first threaded rods rotatably fixed to said first frame plate such that a control member on one of said first threaded rods is driven to linearly move leftward or rightward on said first threaded rod and thereby causing one of said two first movable frame plates, and accordingly, said first left or said first right half of said head section to be pivotally raised at an outer edge and form an inward inclination; said sixteenth rotary wheel being used to drive a second threaded rod rotatably fixed to said second frame plate such that said second left or said second right half of said middle section is inwardly inclined in the same manner and at the same time as said first left or said first right half is inwardly inclined; and said seventeenth rotary wheel being used to drive said third left or said third right half of said rear section to inwardly incline in the same manner and at the same time as said first and said second left halves or said first and said second right halves are inwardly inclined; and a fifth control mechanism having a fifth main shaft extending between and fixed onto two lateral sides of said second frame plate; said fifth main shaft having on each end inside said second frame plate a driving gear to drive a corresponding driven gear to rotate synchronously through a chain wheel and a chain, such that four second racks provided at four bottom corners of said second frame plate engaging with said driving and said driven gears are moved up or down when said fifth main shaft is rotated in a first or in a second reverse direction, causing said middle section to be lowered or elevated; and when said middle section being lowered, a recess being formed to accommodate a bedpan or a urinal therein to facilitate the excretion of the patient.

2. A multipurpose sickbed as claimed in claim 1, wherein said head section and said middle section have alternately disposed first and second fixed boards and first and second movable boards; and said first and said second movable boards being capable of being lowered down to disengage from said first and said second fixed boards to facilitate air ventilation of said sickbed.

3. A multipurpose sickbed as claimed in claim 1, wherein said first movable boards of said head section is capable of being lowered down or elevated to facilitate air ventilation of said sickbed by means of said second control mechanism; the rotation of said second main shaft of said second control mechanism causing said first rotary wheel and said second rotary wheel to rotate synchronously, which further causing said universal joint and said expansion rod to rotate synchronously and thereby bringing said fourth and said fifth rotary wheels to further drive said seventh and said eighth rotary wheels to rotate said first gears between said first fixed boards to engage with said firs tracks formed on said first movable boards and causing said first racks and accordingly, said first movable boards to move down or up.

4. A multipurpose sickbed as claimed in claim 1, wherein when said head section is pivotally raised at its front end to form an inclination, said expansion rod is capable of keeping said first movable boards of said head section being lowered or elevated at a predetermined distance.

5. A multipurpose sickbed as claimed in claim 1, wherein when said middle section is lowered or elevated and therefore a distance between said middle section and said head section, said third rotary wheel brings said sixth, said ninth, and said tenth rotary wheels to keep rotating via links separately connecting said ten th and said ninth rotary wheels as well as said sixth and said third rotary wheels.

6. A multipurpose sickbed as claimed in claim 1, wherein said first, second, and third movable frame plates of said head, middle, and rear sections, respectively, are provided below said fixed and said movable boards, and are hinged to said first, said second, and said third frame plates, respectively, such that said movable frame plates lie in the plane of said frame plates; and, between every two of said first, second, and third movable frame plates, half-crescent members being provided under two inner sides of each of said movable frame plates and to bear against said control members on said threaded rods separately rotatably fixed below said first, second, and third frame plates, such that when said control members are moved leftward or rightward on said threaded rods due to a rotation of the latter, said half-crescent members at one of two sides being pushed to lift said first, second, and third movable frame plates above them, and accordingly, said first, second, third left or right halves of said sickbed.

7. A multipurpose sickbed as claimed in claim 1, wherein said head, middle, and rear sections all are provided with rotary wheels which are connected with links and are therefore capable of keeping synchronous rotating when the distance between these rotary wheels changes.

8. A multipurpose sickbed as claimed in claim 1, wherein said first left half of said head section, said second left half of said middle section, and said third left half of said rear section are inwardly inclined synchronously; and said first right half of said head section, said second right half of said middle section, and said third right half of said rear section are inwardly inclined synchronously.

9. A multipurpose sickbed as claimed in claim 1, wherein said middle section is lowered by rotating said fifth main shaft in a first direction, such that said driving gears connected to said fifth main shaft are turned to drive corresponding driven gears to rotate synchronously through chain wheels and chains, such that said four second racks provided at four bottom corners of said second frame plate engaging with said driving and said driven gears are moved down; and, the rotation of said fifth main shaft in a second reverse direction elevates said lowered middle section again in the same manner.

10. A multipurpose sickbed as claimed in claim 1, wherein said first, second, and third movable frame plates of said head, middle, and rear sections, respectively, all are provided with a plurality of holes on their outer edges to correspondingly receive guide rods formed at bottom side of said first, second, and third left and right movable boards to stably move therein, ensuring engagement of said first racks with said first gears.

11. A multipurpose sickbed as claimed in claim 1, wherein said first, second, and third movable frame plates being hinged to said first, second, and third frame plates, respectively, are further provided with torsional leaf springs on their inner top edges and half-crescent members at their inner bottom edges, such that said left halves of said sickbed keep a horizontal position while said right halves of said sickbeds are synchronously inwardly inclined, and said right halves keep a horizontal position while said left halves of said sickbed are synchronously inwardly inclined.

12. A multipurpose sickbed as claimed in claim 1, wherein said head section is pivotally raised at a front end to form an inclination by means of said first control mechanism which, through said first threaded rod and said first internally threaded block thereon, moves said first trapezoidal member connected to a bottom side of said head section to raise said head section; and said rear section being pivotally raised at a rear end to form an inclination by means of said third control mechanism which, through said second threaded rod and said second internally threaded block thereon, moves said second trapezoidal member connected to a bottom side of said rear section to raise said rear section; and the lowering of said inclined head section and said inclined rear section is effected by rotating said first and said third main shafts, respectively, and by the help of gravity.

* * * * *